United States Patent [19]

L'hermite

[11] Patent Number: 4,623,785

[45] Date of Patent: Nov. 18, 1986

[54] PHOTOMULTIPLIER TUBE WHICH IS INSENSITIVE TO HIGH MAGNETIC FIELDS

[75] Inventor: Pierre L'hermite, Brive, France

[73] Assignee: U.S. Philips Corporation, New York, N.Y.

[21] Appl. No.: 611,264

[22] Filed: May 17, 1984

[30] Foreign Application Priority Data

May 25, 1983 [FR] France ..... 83 08620

[51] Int. Cl.[4] ..... H01J 40/14; H01J 43/04

[52] U.S. Cl. ..... 250/207; 250/213 VT; 313/532

[58] Field of Search ..... 250/207, 213 R, 213 VT; 313/532, 533, 534, 535, 536, 528, 530, 103 R, 104

[56] References Cited

U.S. PATENT DOCUMENTS 2,433,724 5/1944 Wolfgang ..... 313/536

3,114,044 12/1963 Sternglass ..... 250/207

3,183,390 5/1965 Grader et al. ..... 250/207

4,446,401 5/1984 Faulkner et al. ..... 313/532

*Primary Examiner*—Edward P. Westin

*Assistant Examiner*—Stephone B. Allen

*Attorney, Agent, or Firm*—Marc D. Schechter

[57] ABSTRACT

A photomultiplier tube which is insensitive to high magnetic fields comprises a photocathode deposited on a transparent window at the end of an insulating casing. The multiplier tube comprises a single amplifier stage comprising a dynode. The dynode is a metallic sheet with a circumference substantially surrounding the photocathode. A layer of a secondary emissive material is provided on the inner face of the dynode. An anode is formed of a metallic grid which is homeomorphous to the surface of the dynode. The anode is placed parallel to and at a short distance from the inside surface of the dynode.

11 Claims, 1 Drawing Figure

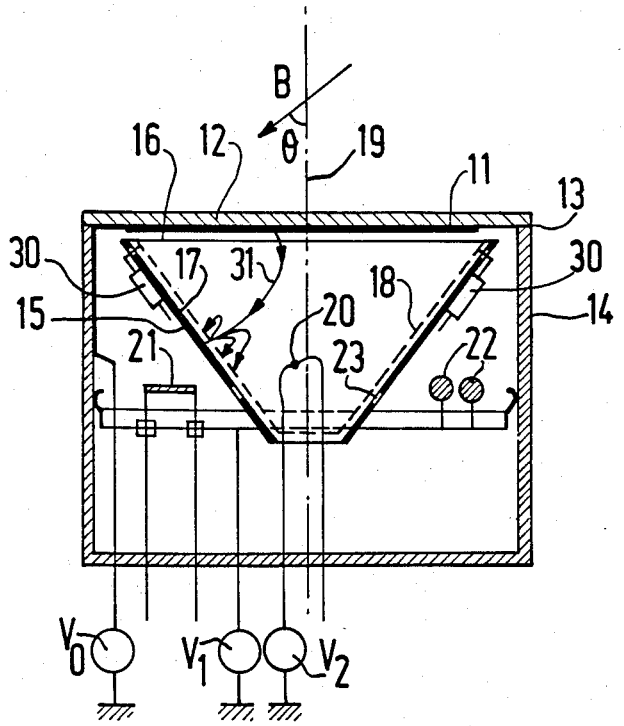
B
θ
16
12
19
11
13
30
17
31
18
30
15
20
14
21
23
22
$V_0$
$V_1$
$V_2$

PHOTOMULTIPLIER TUBE WHICH IS INSENSITIVE TO HIGH MAGNETIC FIELDS

BACKGROUND OF THE INVENTION

The present invention relates to photomultiplier tubes. The tubes comprise a photocathode on a transparent window. The photocathode is a thin layer of a photoemissive material deposited on the transparent window.

The detectors used in particle accelerators generally comprise scintillators associated with mosaics of photomultipliers. The photomultipliers have separate dynodes with gains on the order of $10^4$ to $10^6$.

The sensitivity and hence the energy resolution of these photomultipliers are greatly reduced by the presence of strong magnetic fields which may reach several thousand Gauss. In order to lessen this problem, the photomultipliers are kept away from the immediate proximity of the accelerators. This requires coupling of the photocathodes to the scintillators with light conductors. However, the use of light conductors reduces resolution.

In order to improve the resolution of the detection devices, photoelectric cells are increasingly used instead of photomultipliers. The photoelectric cells are insensitive to the existing strong magnetic fields (that is, under certain angles between the magnetic field and the axes of the cells). However, in contrast to the photomultiplier, the signal must be amplified outside the photoelectric tube. The external amplification which is necessary generates significant noise.

SUMMARY OF THE INVENTION

It is an object of the present invention to provide a photomultiplier tube which is insensitive to magnetic fields of several thousand Gauss, while amplifying the photocathode signal by 5 to 30 times. This amplification can then be followed by external amplifiers without generating excessive noise.

According to the present invention, a photomultiplier tube comprises a dynode formed of a metallic sheet. The sheet has a circumference substantially surrounding the photocathode. The dynode has a layer of a secondary emissive material on its inner surface. An anode is formed by a metallic grid which is homeomorphous to the inner surface of the dynode. The anode is placed parallel to and at a small distance from the dynode.

Thus, the photoelectrons which originate from the photocathode (the paths of which are strongly disturbed by the intense magnetic field) are incident for the most part on the metallic surface of the dynode no matter what the orientation of the magnetic field (provided that the magnetic field is not too parallel with the plane of the photocathode). Few photoelectrons are directly incident on the anode due to the fact that the anode grid is highly transparent, for example 80 to 90% transparent. The photoelectrons incident on the dynode generate secondary electrons which also have disturbed paths. However, the electrons are finally collected by the anode which is at the highest potential.

Moreover, in order to avoid subjecting the photomultiplier tube according to the invention to excessive forces, preferably the dynode and the anode are made of nonmagnetic materials.

BRIEF DESCRIPTION OF THE DRAWING

The drawing is a sectional view of an embodiment of a photomultiplier tube according to the invention.

DESCRIPTION OF THE PREFERRED EMBODIMENTS

The drawing shows a sectional view of a photomultiplier tube which is insensitive to high magnetic fields. The tube comprises a photocathode 11. Photocathode 11 is a thin layer of a photoemissive material deposited on a transparent window 12. Window 12 is sealed to the end 13 of an insulating casing 14. The photocathode 11 is operated at an electric reference potential Vo, for example 0 volts.

As shown in the drawing, the photomultiplier tube has a single amplifier stage. The amplifier stage includes a dynode 15. Dynode 15 is formed of a metallic sheet with a circumference 16 surrounding the photocathode 11.

The dynode 15 has a layer of a secondary emissive material on its inner face 17. For example, the secondary emissive material may be beryllium oxide, magnesium oxide or alkali antimony.

As shown in the drawing, an anode 18 is arranged parallel to and at a small distance from dynode 15. The anode 18 is formed of a metallic grid which is homeomorphous to the surface of the dynode 15. The dynode-anode spacing is typically 0.5 to 1 mm. The spacing is maintained by insulating braces 30. The anode grid is made to be 80 to 90% transparent.

The dynode 15 is operated at an electric potential V1 which is higher than the reference potential Vo. For example, V1 may be 400 to 700 V. The anode 18 is operated at a potential V2 which is higher than the potential V1 of the dynode 15. V2 is on the order of 800 to 1400 V with respect to the reference potential Vo.

Due to the fact that the dynode 15 envelops the photocathode 11, most photoelectrons 31 emitted by the photocathode reach the dynode 15 in spite of the disturbances produced by the magnetic field B (if the angle $\theta$ between the magnetic field and the normal to the photocathode 11 does not exceed 70 to 80° for fields up to 10,000 Gauss). These limits may even be increased if the photocathode is arranged inside the dynode surface.

In the embodiment shown in the drawing, the photocathode 11 is circular. In this case, the surfaces defining the dynode 15 and the anode 18 are preferably surfaces of revolution having a common axis coinciding with the axis 19 of the photocathode 11. As shown in the drawing, the surfaces of revolution may be cones. The conical shape increases the rigidity of the anode grid 18.

Advantageously, the dynode 15 and the anode 18 are made of nonmagnetic material, for example beryllium copper or nonmagnetic inox. This avoids subjecting these elements to large magnetic forces.

Finally, the photoemissive material of the photocathode 11 may be an alloy of antimony and alkali metals, such as $SbK_2Cs$. The photocathode 11 can then be deposited on window 12 by placing evaporators 20 inside the dynode 15 opposite to the photocathode 11. Evaporators 20 contain antimony. Generators 21 and 22 containing the alkali metals (in this case Cs and K, respectively) are placed outside dynode 15. Holes 23 provided in the dynode 15 permit the vapors of the alkali metals to reach the photocathodes 11.

The invention is not restricted by the embodiment shown in the drawing providing a dynode 15 and an anode 18 of a conical shape. Other shapes of dynodes and anodes, in particular spherical, cylindrical, etc., may be used.

What is claimed is:

1. A photomultiplier tube comprising:

a transparent window;

a thin layer of a photoemissive material on the window;

a dynode formed of a metallic sheet with a circumference substantially surrounding the layer of photoemissive material, said dynode having an inner surface with a layer of a secondary emissive material on the inner surface; and an anode formed of a metallic grid, said anode being arranged parallel to and spaced from the inner surface of the dynode.

2. A photomultiplier tube as claimed in claim 1, characterized in that the anode is homeomorphous to the inner surface of the dynode.

3. A photomultiplier tube as claimed in claim 2, characterized in that the anode is arranged 0.5 to 1 millimeter from the inner surface of the dynode.

4. A photomultiplier tube as claimed in claim 1, characterized in that the inner surface of the dynode is arranged transverse to the photoemissive layer.

5. A photomultiplier tube as claimed in claim 1, characterized in that the dynode and the anode form a single amplifier stage.

6. A photomultiplier tube as claimed in claim 5, characterized in that:

the photoemissive layer is a circle having a central axis perpendicular thereto;

the inner surface of the dynode is a surface of revolution around the axis; and the anode is a surface of revolution around the axis.

7. A photomultiplier tube as claimed in claim 6, characterized in that the surfaces of revolution are cones.

8. A photomultiplier tube as claimed in claim 7, characterized in that the dynode and the anode are made of nonmagnetic materials.

9. A photomultiplier tube as claimed in claim 8, characterized in that the photoemissive material is an alloy of antimony and one or more alkali metals.

10. A photomultiplier tube as claimed in claim 1, characterized in that:

the photoemissive layer is a circle having a central axis perpendicular thereto;

the inner surface of the dynode is a surface of revolution around the axis; and the anode is a surface of revolution around the axis.

11. A photomultiplier tube as claimed in claim 10, characterized in that the surfaces of revolution are cones.

* * * * *